US008608508B2

(12) United States Patent
Kataoka

(10) Patent No.: US 8,608,508 B2
(45) Date of Patent: Dec. 17, 2013

(54) RUBBER PLUG AND WATERPROOF CONNECTOR

(75) Inventor: Shigeto Kataoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/538,224

(22) Filed: Jun. 29, 2012

(65) Prior Publication Data

US 2013/0052864 A1 Feb. 28, 2013

(30) Foreign Application Priority Data

Aug. 25, 2011 (JP) ..... 2011-183611

(51) Int. Cl.
*H01R 13/40* (2006.01)

(52) U.S. Cl.
USPC ..... 439/587; 439/589; 439/275

(58) Field of Classification Search
USPC ..... 439/275, 587, 589
See application file for complete search history.

(56) References Cited

U.S. PATENT DOCUMENTS 6,913,486 B2 * 7/2005 Nagayasu et al. ..... 439/587
7,033,216 B2 * 4/2006 Ito ..... 439/587
7,156,698 B2 * 1/2007 Yamashita ..... 439/587

FOREIGN PATENT DOCUMENTS

JP 2011-100599 5/2011

* cited by examiner

*Primary Examiner* — Tho D Ta
(74) *Attorney, Agent, or Firm* — Gerald E. Hespos; Michael J. Porco; Matthew T. Hespos

(57) ABSTRACT

A rubber plug (10) has a plug main body (11) with at least first and second seal holes (13A, 13B) penetrating therethrough. Front and rear first lips (15A) are formed on the inner peripheral surface of the first seal hole (13A) and a valley (16) is defined between the first lips (15A). Front and rear second lips (15B) are formed on the inner peripheral surface of the second seal hole (13B) and a valley (17) is defined between the second lips (15B). The lips (15A, 15B) are disposed so that tips of the first lips (15A) align with the valley (17) of the second seal hole (13B). As a result, the first lips (15A) do not add to compressive forces exerted by the second lips (15B) when a wire is inserted into the second seal hole (13B).

11 Claims, 5 Drawing Sheets

RUBBER PLUG AND WATERPROOF CONNECTOR

BACKGROUND OF THE INVENTION

1. Field of the Invention

The invention relates to a rubber plug and a waterproof connector.

2. Description of the Related Art

Japanese Unexamined Patent Publication No. 2011-100599 discloses a conventional rubber plug with a main body in the form of a mat to be attached to a rear end of a connector housing. Seal holes penetrate through the main body of the rubber plug at positions to communicate with respective cavities of the housing and lips project from the inner peripheral surface of each seal hole. Terminal fittings connected to wires are inserted respectively through the seal holes of the rubber plug and the lips of the seal hole are held resiliently in close contact with the outer peripheral surface of the wire to provide sealing around the wire.

The lips of adjacent seal holes of the rubber plug are arranged at the same positions (same phase positions) in forward and backward directions. Thus, the lips exert compressive forces to each other when the terminal fittings are inserted into the seal holes and the lips are compressively deformed. Thus, the terminal fittings receive large resilient reaction forces from the lips to increase insertion resistance and insertion may be difficult.

The invention was completed based on the above situation and an object thereof is to facilitate inserting a terminal fitting into a seal hole of a rubber plug.

SUMMARY OF THE INVENTION

The invention relates to a rubber plug with a main body and at least first and second substantially adjacent seal holes penetrate through the main body. First lips are formed on the inner peripheral surface of the first seal hole and second lips are provided on the inner peripheral surface of the second seal hole. Terminal fitting connected to wires are inserted through the seal holes so that the lips are held resiliently close contact with the outer peripheral surface of the wire to provide sealing around the wire. The lips are parallel to one another and are arranged successively in the inserting direction of the wires. The second lips are at opposite sides of the first lips relative to the inserting direction of the wire so that the first lips align with a valley between the second lips.

The first lips are deformed compressively when the terminal fitting is inserted into the first seal hole. However, the deformation of the first lips is not affected by the second lips because the valley between the second lips accommodates the deformation of the first lips. As a result, the terminal fitting is inserted more easily into the seal hole of the rubber plug.

Each seal hole preferably comprises two lips. Two first lips and two second lips ensure good sealing without excessively lengthening the seal.

The invention also relates to a waterproof connector with an accommodating recess that receives the above-described rubber plug. An outer lip projects on an outer peripheral surface of the main body of the rubber plug and close contacts the inner peripheral surface of the accommodating recess. Thus, sealing is provided in the accommodating recess.

DETAILED DESCRIPTION OF THE PREFERRED EMBODIMENTS

Figure 1:
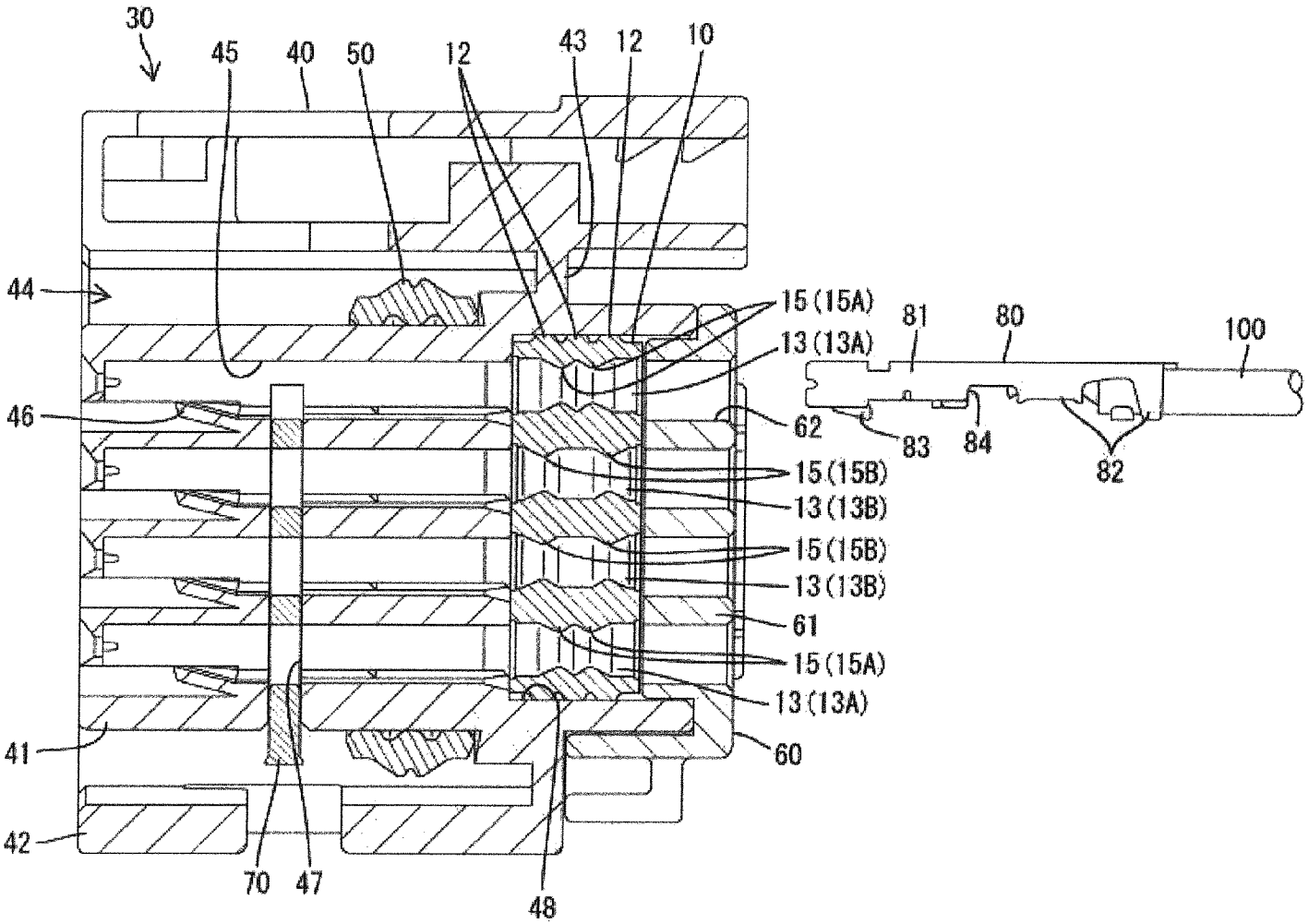
FIG. 1 is a section showing a state where a rubber plug according to one embodiment of the invention is accommodated in an accommodating recess.

A rubber plug 10 in accordance with an embodiment of the invention is identified by the number 10 in FIGS. 1 to 5. The rubber plug 10 is assembled into a housing 40 of a waterproof connector 30 and then a plug presser 60 is mounted into the housing 40. Terminal fittings 80 then are accommodated in the housing 40.

The housing 40 is made of synthetic resin and, as shown in FIG. 1, includes a block-shaped housing main body 41, a tubular fitting 42 surrounding the housing main body 41 and a coupling 43 coupled to rear parts of the housing main body 41 and the tubular fitting 42. A connection space 44 is formed forward of the coupling 43 and between the tubular fitting 42 and the housing main body 41 for accommodating an unillustrated mating housing. A seal ring 50 is mounted before the coupling 43 on the outer peripheral surface of the housing main body 41. The seal ring 50 is compressed resiliently between the mating housing and the housing main body 41 when the mating housing is fit into the connection space 44 of the connector housing 40 to provide between the housings.

Cavities 45 extend in forward and backward directions through the housing main body 41. A resiliently deformable locking lance 46 projects forward from the lower surface of the inner wall of each cavity 45. Further, a retainer mount hole 47 is formed in the housing main body 41 and communicates with the cavities 45. The terminal fitting 80 is inserted into each cavity 45 of the housing main body 41 from behind. The properly inserted terminal fitting 80 is locked primarily by the locking lance 46 and is locked secondarily by the retainer 70 inserted into the retainer mount hole 47. An accommodating recess 48 is formed in the rear of the housing main body 41 for accommodating the rubber plug 10. The rear end of each cavity 45 is open into the accommodating recess 48.

The terminal fitting 80 is formed unitarily by bending an electrically conductive metal plate and, as shown in FIG. 1, is long and narrow in forward and backward directions. Specifically, the terminal fitting 80 includes a tubular main portion 81 and open barrels 82 behind and connected to the main portion 81. The barrels 82 are crimped and connected to an end portion of a wire 100. An unillustrated mating terminal is mounted in the mating housing and is inserted in and connected to the main portion 81 when both housings are connected properly. A locking projection 83 projects on the lower surface of the outer wall of the main portion 81 and engages with the locking lance 46 and a locking edge 84 at the rear end of the main portion 81 engages with the retainer 70.

Figure 4:
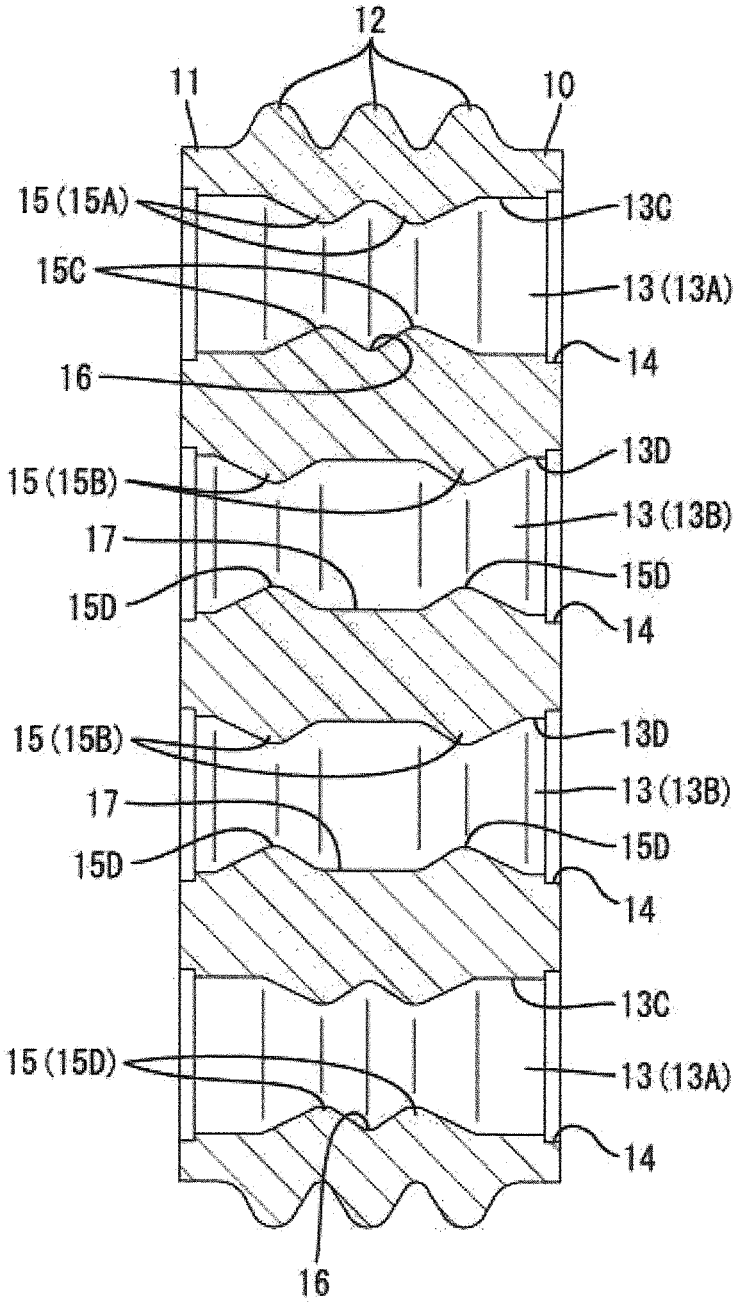
FIG. 4 is a section of the rubber plug.
Figure 5:
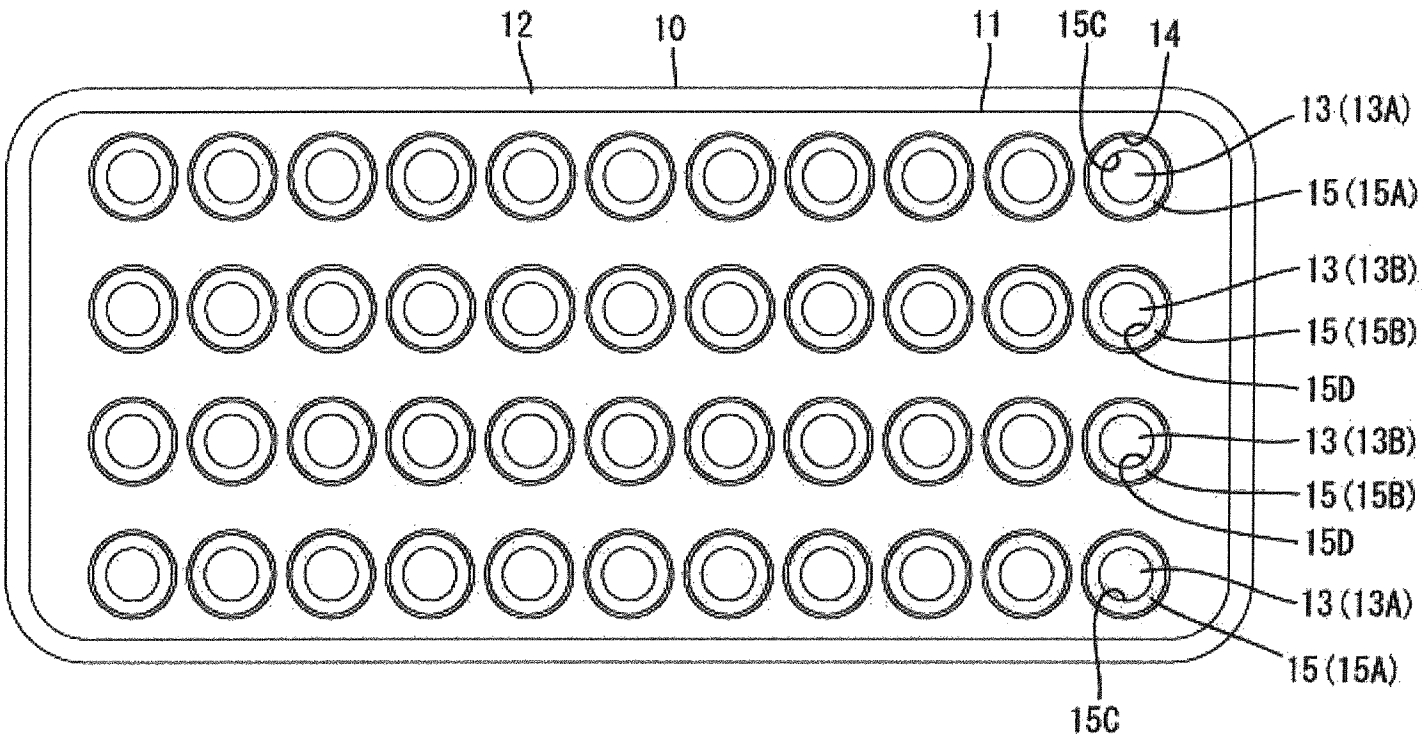
FIG. 5 is a front view of the rubber plug.

The rubber plug 10 is made of rubber, such as silicon rubber, and, as shown in FIGS. 4 and 5, includes a plug main body 11 in the form of a mat. The plug main body 11 is substantially rectangular when viewed from the front and is sized to fit into the accommodating recess 48. Three parallel outer lips 12 project on the outer peripheral surface of the plug main body 11. The outer lips 12 extend around the outer peripheral surface of the plug main body 11 and are arranged successively in forward and backward directions. The outer lips 12 are held resiliently in close contact with the peripheral surface of the accommodating recess 48 while being compressed so that sealing is provided in the accommodating recess 48.

Seal holes 13 penetrate the plug main body 11 in forward and backward directions at positions corresponding to the respective cavities 45. The seal holes 13 have circular cross sections and equal diameter, and are arranged in a height direction and a width direction in the plug main body 11. Large-diameter portions 14 are formed at front and rear ends of the seal holes 13 via steps and are open on the both front and rear surfaces of the plug main body 11.

Parallel lips 15 project on an inner peripheral surface 13C, 13F of each seal hole 13 of the plug main body 11. The lips 15 extend around the inner peripheral surface 13C, 13D of each seal hole 13 and are arranged in forward and backward directions (inserting direction of the wire 100). The seal holes 13 that are adjacent to each other in the height direction are referred to as first and second seal holes 13A and 13B. The lips 15 of the first and second seal holes 13A, 13B are arranged at positions different from each other in forward and backward directions.

Specifically, the first seal holes 13A are arranged on opposite sides of the plug main body 11 in the height direction and have the inner peripheral surface 13C at a position back to back with the outer peripheral surface of the plug main body 11. The first seal hole 13A has parallel front and rear first lips 15A successively arranged in forward and backward directions at a central part of the inner peripheral surface 13C. A first valley 16 of U-shaped cross section is formed between the front and rear first lips 15A on the inner peripheral surface 13C of the first seal hole 13A.

Tips 15C of the first lips 15A are at positions facing positions between the outer lips 12 in forward and backward directions. That is, the first lips 15A and the outer lips 12 are arranged in different phases from each other in forward and backward directions. Further, the projecting height of the respective first lips 15A is lower than the projecting height of the outer lips 12.

The second seal holes 13B are arranged in upper and lower levels in a central part of the plug main body 11 in the height direction and have the inner peripheral surface 13D at a position back to back with the inner peripheral surface 13C of the first seal hole 13A. The second seal hole 13B has parallel front and rear second lips 15B spaced apart at front and rear end parts of the inner peripheral surface 13D. The second lips 15B have substantially the same shape as the first lips 15A and the projecting height of the second lips 15B is lower than the projecting height of the first lips 15A.

A second valley 17 is formed between the front and rear second lips 15B on the inner peripheral surface 13D of the second seal hole 13B of the plug main body 11 and is of constant diameter along forward and backward directions. The length of each second valley 17 in forward and backward directions is longer the length between the tips 15C of the first lips 15A in forward and backward directions.

Tips 15D of the front and rear second lips 15B are forward and rearward respectively of the tips 15C of the respective front and rear first lips 15A. More specifically, the tips 15C of the first lips 15A overlap the second valleys 17 in forward and backward directions. Further, bases of the respective first and second lips 15A, 15B partly overlap each other in forward and backward directions. Note that the entire rubber plug 10 is front and back symmetrical with respect to its center in forward and backward directions.

The plug presser 60 is made of synthetic resin and, as shown in FIG. 1, includes a presser main body 61 in the form of a flat plate that can contact the rear surface of the rubber plug 10. The presser main body 61 is inserted into the accommodating recess 48 of the housing main body 41 after the rubber plug 10. Wire insertion holes 62 penetrate the presser main body 61 in forward and backward directions at positions communicating with the respective seal holes 13. The terminal fitting 80 is passed loosely through the wire insertion holes 62 and then the wire 100 is inserted loosely into each wire insertion hole 62 of the presser main body 61. The plug presser 60 also is formed with an unillustrated lock to engage with the housing. The rubber plug 10 is sandwiched resiliently between the presser main body 61 and the housing main body 41 in forward and backward directions when the plug presser 60 is mounted on the housing main body 41 via the lock.

In assembling, the rubber plug 10 is inserted into the accommodating recess 48 of the housing main body 41 and then the presser main body 61 of the plug presser 60 is inserted, as shown in FIG. 1. Thus, the plug presser 60 retains the rubber plug 10 in the accommodating recess 48. As a result, the wire insertion holes 62 of the plug presser 60 align respectively with the seal holes 13 of the rubber plug 10 and communicate coaxially in forward and backward directions with the respective cavities 45 of the housing main body 41.

Figure 2:
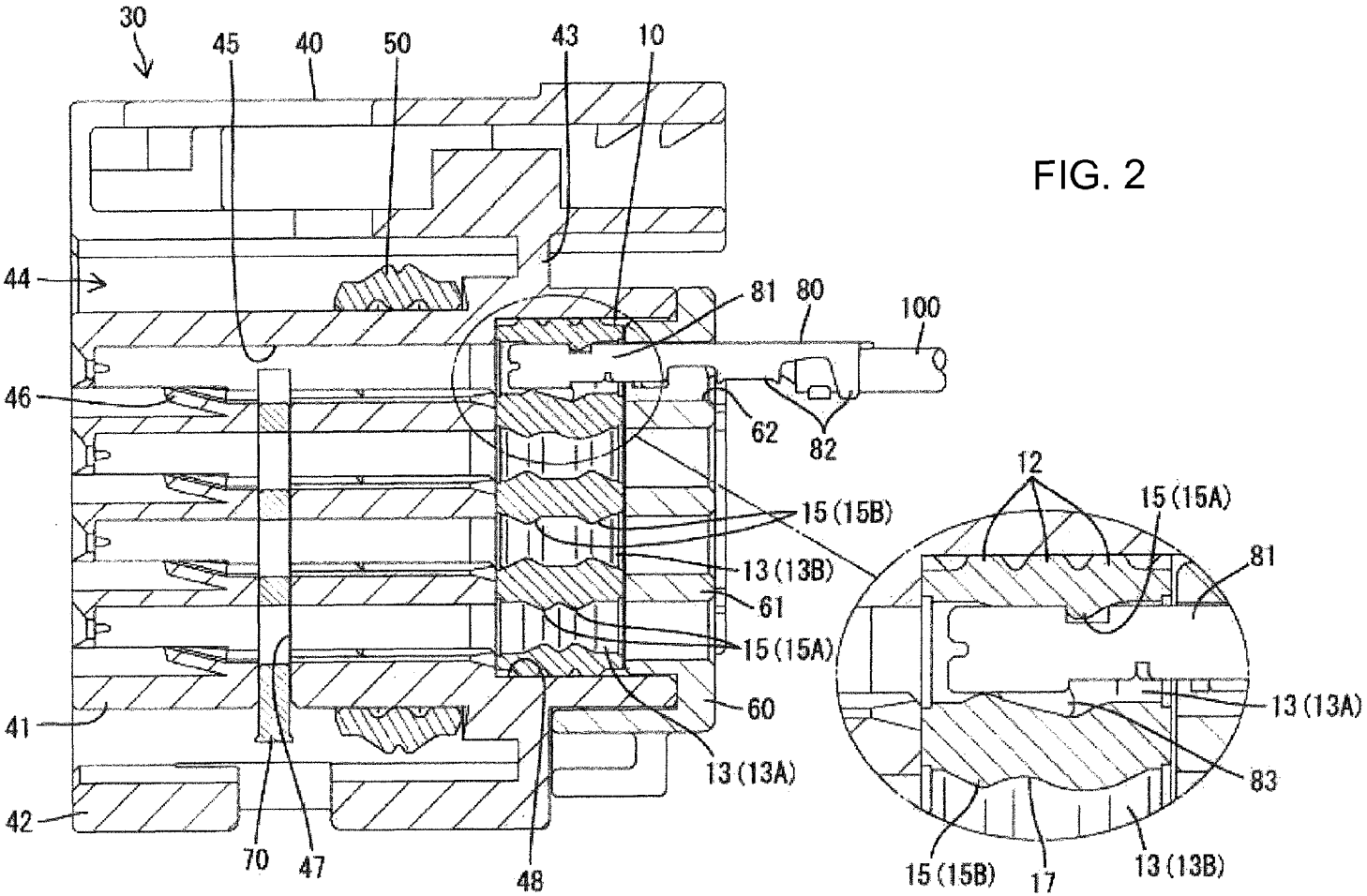
FIG. 2 is a section showing a terminal fitting in a seal hole of the rubber plug.

Subsequently, the terminal fitting 80 connected to the wire 100 is inserted into the cavity 45 of the housing main body 41 from behind. The terminal fitting 80 is inserted into the corresponding cavity 45 through the wire insertion hole 62 and then the seal hole 13. When the terminal fitting 80 is inserted into the first seal hole 13A, as shown in FIG. 2, the main portion 81 of the terminal fitting 80 interferes with the first lips 15A and the first lips 15A are deformed compressively. The adjacent second seal hole 13B is affected by deformation of the respective first lips 15A. However, deformation of the second seal hole 13B by the first lips 15A is absorbed by the second valley 17 between the adjacent second lips 15B. Thus, the compressively deformed first lips 15A transmit compressive to the second valley 17 facing the first lips 15A and the second valley 17 is deformed within the depth thereof. Accordingly, adjacent first lips 15A do not exercise compressive forces against each other.

Figure 3:
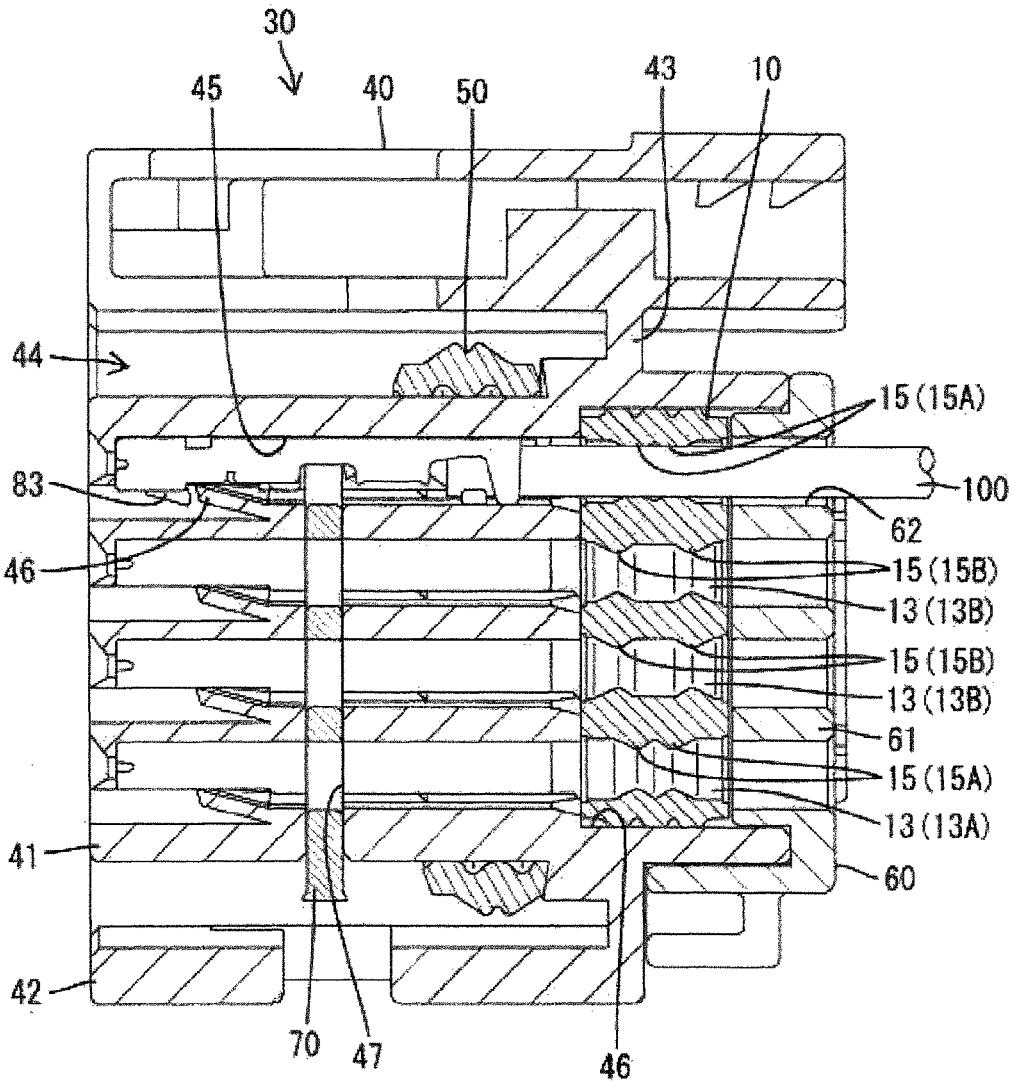
FIG. 3 is a section showing a wire in the seal hole of the rubber plug.

The locking lance 46 engages the locking projection 83 from behind when the terminal fitting 80 is inserted properly into the cavity 45 through the seal hole 13 of the rubber plug 10, as shown in FIG. 3,. The retainer 70 then is inserted to a proper depth into the retainer mount hole 47 and engages the locking edge 84 of the main portion 81 from behind. In this way, the terminal fitting 80 is accommodated and retained in the cavity 45.

The wires 100 are in the respective seal holes 13 of the rubber plug 10 when the terminal fittings 80 are inserted properly in the cavities 45 and the lips 15 are held resiliently in close contact with the outer peripheral surfaces of the wires 100 while being compressed to provide sealing around the wires 100. The housing 40 then is connected to the mating housing so the terminal fittings 80 electrically connect to the mating terminals.

As described above, the respective first lips 15A are deformed compressively when the terminal fitting 80 is inserted into the first seal hole 13A. However, deformation of the first lips 15A is absorbed by the second valley 17 between the adjacent second lips 15B. Thus, the first and second lips 15A, 15B do not exercise compressive forces against each other. As a result, the terminal fitting 80 is inserted into the seal hole 13 of the rubber plug 10 more easily.

Further, two first lips 15A and two second lips 15B are provided. Thus, good sealing is ensured without excessively lengthening the first and second seal holes 13A, 13B in forward and backward directions. Furthermore, the outer lips 12 of the rubber plug main body 11 are held in close contact with the inner peripheral surface of the accommodating recess 48 to provide sealing in the accommodating recess 48.

The invention is not limited to the above described embodiment. For example, the following embodiments also are included in the scope of the invention.

The numbers of the first and second seal holes are not limited to those in the above embodiment.

The first seal holes may be arranged in the central part of the plug main body in the height direction and the second seal holes may be arranged on the opposite sides of the plug main body in the height direction.

The first and second seal holes may be adjacent to each other in the width direction in the plug main body.

The numbers of the first and second lips may be three or more.

The terminal fittings may be male terminal fittings with a male tab.

What is claimed is:

1. A rubber plug, comprising:

a plug main body formed with first and second seal holes penetrating therethrough, each seal hole having an inner peripheral surface;

front and rear first lips formed on the inner peripheral surface of the first seal hole and a valley being defined between the front and rear first lips;

front and rear second lips formed on the inner peripheral surface of the second seal hole and a valley being defined between the front and rear second lips; and the lips being disposed so that tips of the first lips align with the valley of the second seal hole.

2. The rubber plug of claim 1, wherein each of the seal holes has only two lips.

3. The rubber plug of claim 1, wherein the lips are parallel.

4. The rubber plug of claim 3, wherein the valley of the second seal hole is substantially cylindrical.

5. The rubber plug of claim 1, further comprising a plurality of outer lips extending around an outer periphery of the rubber plug.

6. A rubber plug, comprising:

a plug main body having opposite front and rear surfaces and at least first and second seal holes penetrating through the plug main body from the front surface to the rear surface, each seal hole having an inner peripheral surface;

front and rear first lips formed on the inner peripheral surface of the first seal hole, the front first lip being spaced a first distance from the front surface of the plug main body and the rear first lip being spaced the first distance from the rear surface of the plug main body, a valley being defined between the front and rear first lips; and front and rear second lips formed on the inner peripheral surface of the second seal hole, the front second lip being spaced a second distance from the front surface of the plug main body and the rear second lip being spaced the second distance from the rear surface of the plug main body, and a valley being defined between the front and rear second lips, the second distance being less than the first distance so that tips of the first lips align with the valley of the second seal hole.

7. The rubber plug of claim 6, wherein the valley of the second seal hole is substantially cylindrical.

8. A waterproof connector, comprising:

a housing having opposite front and rear ends, an accommodating recess formed in the rear end and cavities extending from the accommodating recess to the front end; and a rubber plug mounted in the accommodating recess and having a plug main body, first and second seal holes penetrating through the plug main body, each seal hole having an inner peripheral surface, front and rear first lips formed on the inner peripheral surface of the first seal hole and a valley being defined between the front and rear first lips, front and rear second lips formed on the inner peripheral surface of the second seal hole and a valley being defined between the front and rear second lips, tips of the first lips being aligned with the valley of the second seal hole.

9. The waterproof connector of claim 8, further comprising a plug presser mounted to the rear end of the housing for holding the rubber plug in the accommodating recess.

10. The waterproof connector of claim 9, wherein the plug presser has wire insertion holes aligned respectively with the seal holes in the rubber plug.

11. The waterproof connector of claim 8, further comprising a plurality of outer lips extending around an outer periphery of the rubber plug and sealingly engaged with the accommodating recess.

* * * * *